US010845765B2

(12) United States Patent
Lombardi

(10) Patent No.: US 10,845,765 B2
(45) Date of Patent: Nov. 24, 2020

(54) METRONOME FOR IMPROVING MUSICIAN'S SKILL

(71) Applicant: Donald G. Lombardi, Oxnard, CA (US)

(72) Inventor: Donald G. Lombardi, Oxnard, CA (US)

(73) Assignee: DRUM CHANNEL, LLC, Oxnard, CA (US)

( * ) Notice: Subject to any disclaimer, the term of this patent is extended or adjusted under 35 U.S.C. 154(b) by 0 days.

(21) Appl. No.: 16/222,887

(22) Filed: Dec. 17, 2018

(65) Prior Publication Data

US 2019/0294119 A1 Sep. 26, 2019

Related U.S. Application Data

(60) Provisional application No. 62/599,269, filed on Dec. 15, 2017.

(51) Int. Cl.
*G04F 5/02* (2006.01)

(52) U.S. Cl.
CPC ..... *G04F 5/025* (2013.01)

(58) Field of Classification Search
CPC ..... G04F 5/025
USPC ..... 84/484
See application file for complete search history.

(56) References Cited

U.S. PATENT DOCUMENTS 3,554,073 A * 1/1971 Castilloux ..... G10H 1/40 84/484
4,014,167 A * 3/1977 Hasegawa ..... G10H 1/40 84/484
4,193,257 A * 3/1980 Watkins ..... G04F 5/025 340/384.71
4,204,400 A * 5/1980 Morohoshi ..... G04F 5/025 340/384.71
4,442,752 A * 4/1984 Tsuchiya ..... G04F 10/00 84/484
4,649,794 A * 3/1987 George ..... G04F 5/025 340/815.45
4,733,593 A * 3/1988 Rothbart ..... G04F 5/025 84/484
4,982,642 A * 1/1991 Nishikawa ..... G04F 5/025 84/484
5,275,082 A * 1/1994 Kestner-Clifton ..... G10G 7/00 84/464 R
5,447,089 A * 9/1995 Marrash ..... G04F 5/025 84/484
6,175,632 B1 * 1/2001 Marx ..... H04R 29/008 381/56
7,432,433 B2 * 10/2008 Boxer ..... G04F 5/025 84/477 R
7,531,734 B2 * 5/2009 Kobayashi ..... G04F 5/025 84/477 R
7,557,287 B2 * 7/2009 Wilson ..... G04F 5/02 84/484

(Continued)

*Primary Examiner* — David S Warren
*Assistant Examiner* — Christina M Schreiber
(74) *Attorney, Agent, or Firm* — Ferguson Case Orr Paterson

(57) ABSTRACT

A programmable metronome comprising input controls to set the starting tempo, number of tempo intervals, and the speed of the tempo at the various intervals, and the length of the intervals. The metronome then generates a series of sounds based on said input controls, said series of sounds used for music practice and training.

14 Claims, 3 Drawing Sheets

(56) References Cited

U.S. PATENT DOCUMENTS

| | | | | |
|---|---|---|---|---|
| 8,278,542 | B2 * | 10/2012 | Kashioka | G09B 15/00 84/484 |
| 2005/0211073 | A1 * | 9/2005 | Kobayashi | G09B 15/00 84/612 |
| 2005/0215846 | A1 * | 9/2005 | Elliott | A61M 21/00 600/26 |
| 2006/0101983 | A1 * | 5/2006 | Boxer | G04F 5/025 84/484 |
| 2011/0009713 | A1 * | 1/2011 | Feinberg | A61B 5/02438 600/301 |
| 2017/0018202 | A1 * | 1/2017 | Marradi | G10H 1/0016 |
| 2017/0285578 | A1 * | 10/2017 | Vogels | G04F 5/025 |
| 2019/0294119 | A1 * | 9/2019 | Lombardi | G04F 5/025 |

* cited by examiner

METRONOME FOR IMPROVING MUSICIAN'S SKILL

This application claims the benefit of U.S. Provisional Patent Application Ser. No. 62/599,269 to Lombardi, filed on Dec. 15, 2017.

BACKGROUND OF THE INVENTION

Field of the Invention

The present invention relates to different embodiments of improved metronomes that can more effectively improve a musician's playing skills.

Description of the Related Art

Metronomes are known in the musical arts, with conventional metronomes being a fixed time-keeping device used during musical instruction and training. Conventional metronomes are mechanical devices that produce an audible beat (a click or other sound) at regular intervals that the user can set in beats per minute (BPM). Musicians often use metronomes to practice playing to a regular pulse and most metronomes typically include synchronized visual motion indicator such as a swinging pendulum or blinking lights. Musicians practice with metronomes to improve their timing, especially the ability to stick to a particular tempo. Metronome practice helps internalize a clear sense of timing and tempo. Composers often use metronomes as a standard tempo reference and may play or sing their work to the metronome to derive beats per minute if they want to indicate that in a composition.

Metronomes can be also used to document how fast a musician can perform a skill. A musician can play an exercise at a certain tempo and then manually reset the fixed tempo of a metronome to an increased speed to improve playing speed. The musician can manually log the playing speed to know what tempo was used for the last practice session and what tempo to start at for the next practice session.

SUMMARY OF THE INVENTION

The present invention is directed to improved metronomes, and in particular to improved programmable metronomes that can be programmed to provide varying tempos at the different intervals to more effectively improve a musician's playing skills.

A embodiment of a programmable metronome according to the present invention comprises input controls to set the starting tempo, number of tempo intervals, the speed of the tempo at the various intervals, and the length of the intervals. The metronome then generates a series of sounds based on said input controls, said series of sounds used for music practice and training.

The metronomes according to the present invention can store the last tempo settings from a training session, or can store information from multiple past training sessions. These stored settings can be used in subsequent training sessions to provide the user's history of the metronome training.

These and other aspects and advantages of the invention will become apparent from the following detailed description and the accompanying drawings, which illustrate by way of example the features of the invention.

DESCRIPTION OF THE INVENTION

Figure 1:
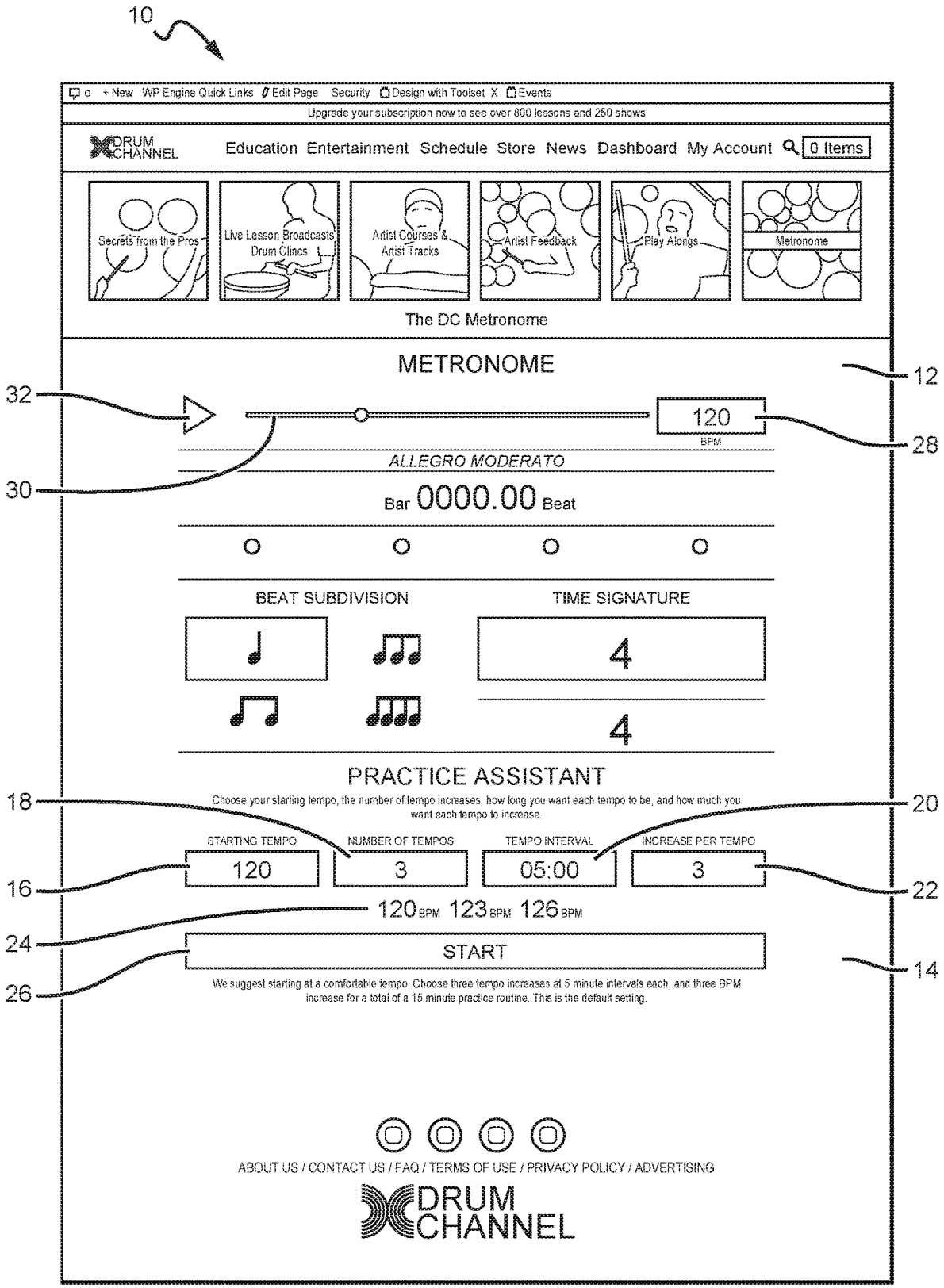
FIG. 1 shows one embodiment of a screen shot or display for a variable and controllable metronome according to the present invention.

Metronome time-keeping devices according to the present invention can be easily programmed to provide various speeds and different intervals, which can provide for improved musician training. Some metronomes according to the present invention can function in a standard mode keeping a fixed tempo. The metronomes can also be programmed to set various numbers of tempos at various speeds and at various intervals, and can retain the last setting when stopped. The metronomes can be programmed to set a starting tempo and can be programmed to set an increase in tempo at different intervals. The metronomes can also be set to the desired number of times to continue to increase the tempo, and set how long each tempo will last. When stopped, the last setting can retained in memory and can appear when the metronome is used again. The history of metronome use for a particular user can also be saved to track the user's training progress.

Different metronome embodiments according to the present invention can provide simplified and convenient methods and device for improving a musician playing skill. The metronomes according to the present invention can be used with musicians training with many different instruments. By way of example, some embodiments can be used to allow a drummer to increase his playing speed by practicing at progressively increasing tempos, all under control of the drummer. In a typical practice session, the new metronome can be programmed by the drummer or his instructor to allow the drummer to set a first fixed practice time, such as 15 minutes. The device can also be programmed to increase the tempo at certain intervals and by a certain amount, for example, the tempo can increase a certain number of beats every 5 minutes. The metronomes according to the present invention become "tutors" that force the drummer to push his skill faster as it automatically increases tempo. It eliminates the current manual way of starting and stopping the practice session to track the tempo and manually increase the tempo.

It is understood that the metronomes according to the present invention can be embodied as mechanical, electronic or software based devices, or a combination thereof. In mechanical embodiments according to the present invention, the different fields or operating characteristics of the metronome can be input or controlled using buttons, dials or other mechanical activators. These can also be software components to the mechanical embodiments that read the mechanical inputs and then determine how the metronome will perform based on the input.

In the embodiment described herein, the metronomes can be primarily software based, and can have controls and displays that are available on a display or screen. The metronomes can be accessed through a local computer program or through a web site, with the controls and displays on a computer screen. In other embodiments, the metronome can be accessed by cell phone (e.g. such as through a cell phone app), and shown and programmed through the cell phone screen. In each of the embodiments, the last training session parameters and training performance can be stored in memory. In some embodiments this can be in local computer memory, server memory or in the Cloud. In other embodiments, the information can be stored on portable memory devices such as USB sticks or thumb drives.

The present invention is described herein with reference to certain embodiments, but it is understood that the invention can be embodied in many different forms and should not be construed as limited to the embodiments set forth herein.

Embodiments of the invention are described herein with reference to certain electronic displays or screen shots, but is it understood that the metronomes according to the present invention can be provided using many different displays arranged in many different ways.

Figure 2:
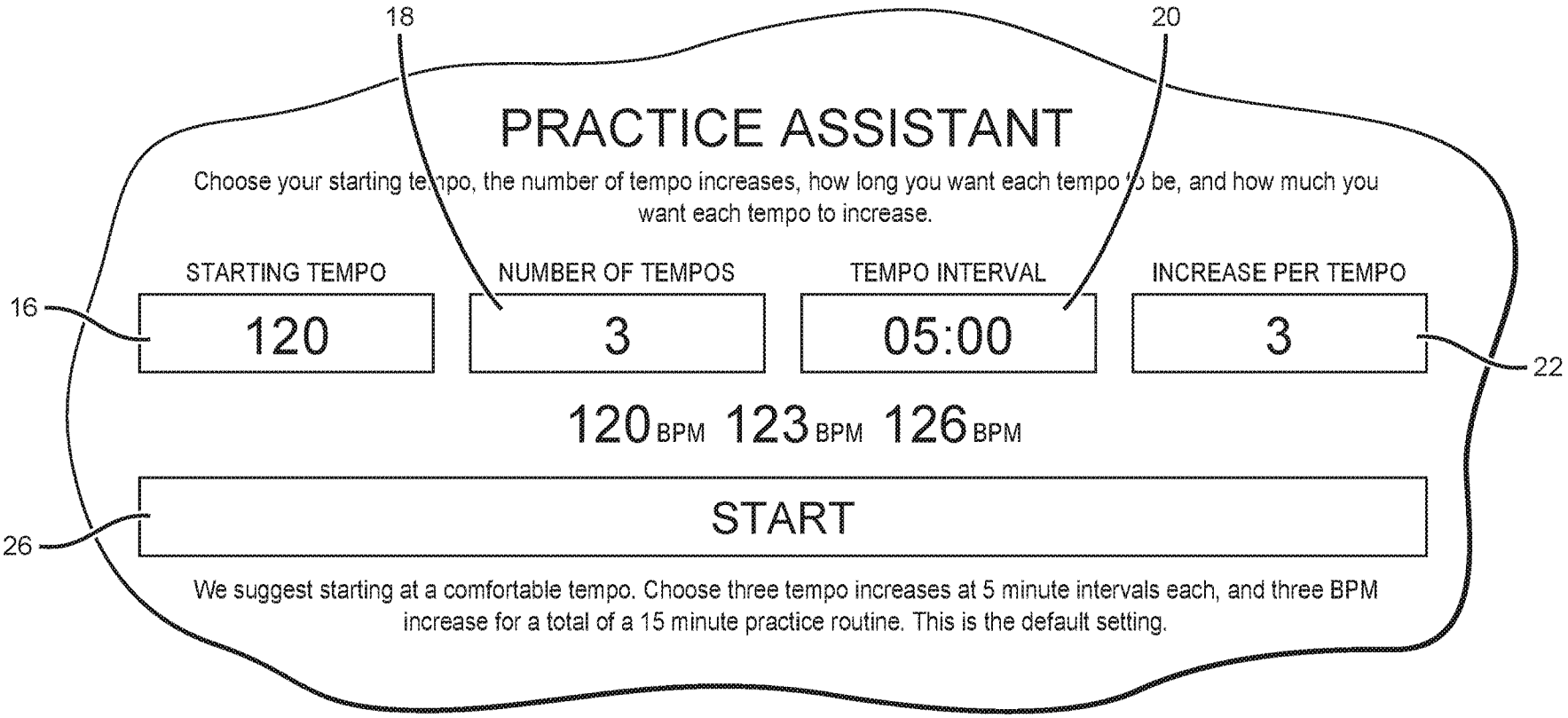
FIG. 2 is a screen shot for the displays and controls of the metronome shown in FIG. 1.

FIG. 1 shows one embodiment of a metronome display 10 or screen shot according to the present invention, showing the operational information 12 of the metronome on the upper portion of the display and the "Practice Assistant" 14 in the lower portion. FIG. 2 shows a close-up of the Practice Assistant display and the fields that can be used in programming the metronome. The data in each of the fields can be updated in many different ways such as by computer keyboard, computer mouse or by touch from a touch-screen. In still other embodiments that fields can be updated by voice activation, such as through use of voice recognition software. The metronome will perform in different ways depending on the numbers or data entered in the fields. Different embodiments can have different fields in different locations according to the present invention, with the display 10 only having one of the many different arrangements according to the present invention.

Referring now to FIG. 2, the Practice Assistant 14 allows the metronome according to the present invention to be programmable as described above. The Practice Assistant has a "Starting Tempo" field 16 that allows the user to program the starting tempo for the training session. In the example shown, the field 16 shows the starting tempo is programmed to 120. A tempo of 120 signifies 120 beats per minute, while a tempo of 60 signifies a tempo of 60 beats per minute. It is understood that this field can include many different tempos beyond those described above.

The display 10 also includes a "Number of Tempos" field 18 that allows the user to program the number of tempo increases in the training session. In the embodiment shown the number of tempos input by the user is 3, but other field can use fewer or more tempo increases, with some embodiment having up to a dozen or more tempo increases.

The display 10 also includes a "Tempo Interval" field that allows the user to program the length of each interval at each of the tempos. In the embodiment shown Tempo Interval field 20 indicate and in interval being 5 minutes long. That is, each tempo of the 3 tempos indicated from the Number of Tempos field 18, will last 5 minutes long. It is understood that this time can be shorter or longer as desired.

The display 10 also includes an "Increase for Tempo" field 22 that allows the user to program the increase in the tempo for each of intervals. In the embodiment shown, the increase is shown as 3 beats which results in an increase of 3 beats in the tempo for each of the number of tempos. That is, the starting tempo in the embodiment shown is 120, and with each of the of the number of tempos as shows in field the tempo increases by 3 to go from 120 in the first tempo, 123 in the second tempo, and 126 in the third tempo.

In the display 10, below the four fields 16, 18, 20 and 22, the Practice Assistant 14 can include the current tempo display 24 that shows the current tempo being run by the metronome according to the present embodiment. The different number of tempos and the tempo for each of the different number of tempos is also shown as programmed by the user in the four fields. In this example, the fields were used to program three different tempos starting at 120 and increasing by three in each tempo as described above. The different tempos are shown as $120_{BPM}$, $123_{BPM}$, and $126_{BPM}$. The Practice Assistant can also highlight the particular one of the tempos that is currently being run, with the $120_{BPM}$ tempo being highlighted. The Practice Assistant also has a "Start" button that can be activated in many different ways to begin the training session. In some embodiments the Start button 26 can be activated by computer keyboard, computer mouse or by touch from a touch-screen. In still other embodiments that Start button can be activated by voice activation, such as through use of voice recognition software.

The top portion 12 of the metronome display also shows the current tempo 28 of the metronome (e.g. $120_{BPM}$). This will increase or decrease with the different numbers of tempos, as programmed by the user (e.g. $123_{BPM}$ to $126_{BPM}$). The top portion 12 also has an upper scale 30 that shows visually shows how much of the particular interval or tempo has passed. In the embodiment shown, the time scale shows time passed for the particular one of the tempos. The time passed for scale 30 in the embodiment shown is for the first tempo of $120_{BPM}$, with the line of the scale representing the length of time and the ball on the line showing how much time has passes. A top portion stop/start button 32 is also included to allow the user to start or stop the tempo time as desired. Any of the control methods mention above can be used.

Figure 3:
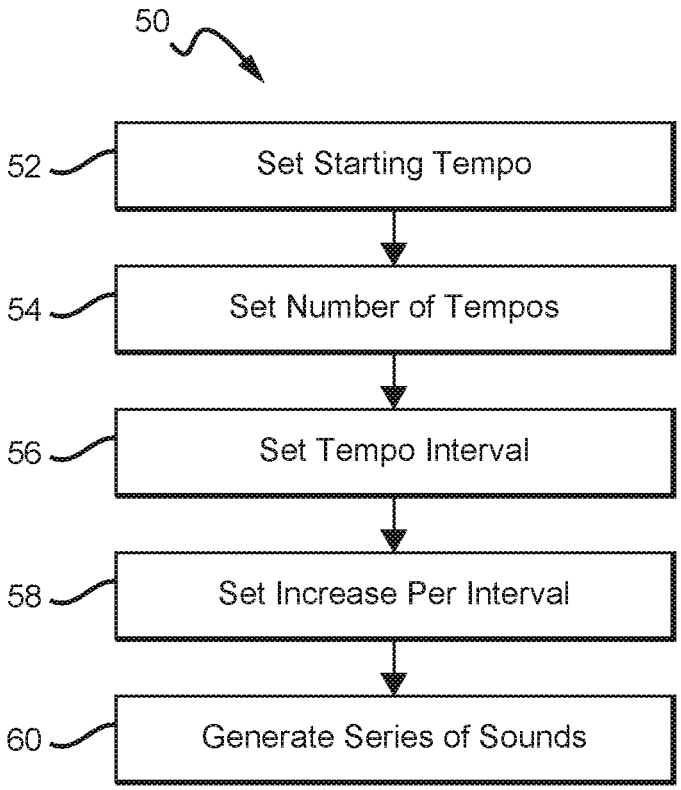
FIG. 3 is a flow diagram for one embodiment of a method according to the present invention.

FIG. 3 shows one embodiment of a method 50 according to the present invention for programming a metronome pursuant to the fields and inputs described above. In step 52 the starting tempo for the metronome is set as described above, with one embodiment having a tempo of $120_{BPM}$. In step 54, the number for tempos is set, with the embodiments as described above being set so that it has 3 tempos. In step 56, the tempo interval is set, which dictates the length of each tempo interval. In the embodiment described above the tempo interval was set to 5 minutes. In step 58 the tempo increase in each interval is set, with the increase as described above being set to 3 beats. In step 60, the method takes all these settings (or inputs) and generates a series of sounds that is used in music practice or training. In the embodiment described above and in this method, the series of sounds will start with 120 beats per minute for a first 5 minute interval. At the end of the first 5 minute period the speed of the sounds will increase to 123 beats per minute for a second 5 minute period. At the end of the second period the speed of the sounds will increase to 126 beats per minute for a third 5 minute period. At the end of the third 5 minute period the series of sounds ends, which can be the end of the practice session.

As discussed above, the metronome according to the present invention can store the last of the tempos from the training session. When the musician returns to the metronome, the last tempo can be shown. Accordingly, the user does not need to manually record the last tempo to recall where the last training session ended. It is understood that other embodiments can store additional information from many previous training sessions so that the user can have a complete history of training sessions. In other embodiments, the metronome can store all information from all the fields from multiple training sessions and can also record if the user completed the particular training session.

The metronome display 10 can also comprise different fields to assist during the metronome in training session. In the embodiment shown, the metronome display also includes "Beat Subdivision" and "Time Signature" fields. These are only a couple of the additional fields that can be included according to the present invention. The display 10 can also show the type of tempo, with the embodiment shown indicating "Allegro Moderato."

Although the present invention has been described in detail with reference to certain preferred configurations thereof, other versions are possible. For example, the embodiments described above increase the tempo subsequent intervals, but it is understood that other embodiments can decrease the tempo during subsequent intervals or can be programmed so that the tempo increases and decreases though the intervals in different ways during a particular training session. Therefore, the spirit and scope of the invention should not be limited to the versions described above.

We claim:

1. A programmable metronome, comprising:

input controls to set the starting tempo, number of tempo intervals, length of the tempo intervals, and rate of tempo increase from each of said tempo intervals to the next tempo interval;

wherein said metronome is configured to generate a series of sounds based on said input controls, said series of sounds for music practice;

wherein said metronome is configured to automatically move through the tempo intervals during a training session; and wherein the rate of tempo increase is a constant value.

2. The metronome of claim 1, wherein the rate of tempo increase is a constant value when there are three or more tempo intervals.

3. The metronome of claim 1, arranged to retain the last tempo settings when exiting or turning off said metronome.

4. The metronome of claim 1, arranged to retain a plurality of last tempo settings when exiting or turning off said metronome.

5. The metronome of claim 1, arranged such that the length of the tempo intervals is the same for all of the tempo intervals.

6. The metronome of claim 1, arranged such that the length of the tempo intervals is variable among the tempo intervals.

7. The metronome of claim 1, arranged to allow for stopping and starting during the tempo intervals.

8. A method for programming a metronome, comprising:

setting the starting tempo of the metronome;

setting the number of tempo intervals;

setting the tempo increase from each tempo interval to the next tempo interval;

setting the length of time for each of said tempo intervals; and generating a series of sounds based on the starting tempo of the metronome, the number of tempo intervals, the tempo increase from each tempo interval to the next tempo interval, and the length of time for each of said tempo intervals, including automatically moving from tempo interval to tempo interval with a rate of tempo increase that is a constant value.

9. The method of claim 8, wherein there are at least three tempo intervals.

10. The method of claim 8, further comprising retaining the last tempo settings when stopping use of said metronome.

11. The method of claim 8, further comprising retaining a plurality of last tempo settings when stopping use of said metronome.

12. The method of claim 8, wherein the length of time for each of said tempo intervals is constant.

13. The method of claim 8, wherein the length of time changes from a first of said tempo intervals to a second of said tempo intervals.

14. The method of claim 8, further comprising stopping and starting during at least one of said tempo intervals.

* * * * *